US012180696B1

(12) United States Patent
Salem et al.

(10) Patent No.: US 12,180,696 B1
(45) Date of Patent: Dec. 31, 2024

(54) SYSTEMS AND METHODS FOR RESISTING SOFT STORY COLLAPSE

(71) Applicants: Hamed M. M. Salem, Giza (EG); Edward R. diGirolamo, Raleigh, NC (US)

(72) Inventors: Hamed M. M. Salem, Giza (EG); Edward R. diGirolamo, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 661 days.

(21) Appl. No.: 17/198,135

(22) Filed: Mar. 10, 2021

Related U.S. Application Data

(60) Provisional application No. 62/987,701, filed on Mar. 10, 2020.

(51) Int. Cl.
*E04B 1/24* (2006.01)

(52) U.S. Cl.
CPC ..... *E04B 1/24* (2013.01); *E04B 2001/2481* (2013.01); *E04B 2001/2484* (2013.01); *E04B 2001/2496* (2013.01); *E04B 2103/06* (2013.01)

(58) Field of Classification Search
CPC ..... E04H 9/021; E04H 9/024; E04H 9/02; E05B 2063/0095; E04B 1/24
See application file for complete search history.

(56) References Cited

U.S. PATENT DOCUMENTS 5,664,392 A * 9/1997 Mucha ..... E04B 2/96 52/285.3
5,906,080 A * 5/1999 diGirolamo ..... E04B 2/7453 52/656.1
6,058,668 A * 5/2000 Herren ..... E04B 2/825 52/236.7
6,612,087 B2 * 9/2003 diGirolamo ..... E04B 2/825 52/712
7,503,150 B1 * 3/2009 diGirolamo ..... E04B 2/96 52/703
8,181,419 B1 * 5/2012 diGirolamo ..... E04B 2/768 52/712
8,387,321 B2 3/2013 diGirolamo et al.
8,511,032 B2 * 8/2013 Abdel-Rahman ..... E04B 2/88 52/573.1
8,683,770 B2 * 4/2014 diGirolamo ..... E04B 2/768 52/712
10,087,617 B2 * 10/2018 Daudet ..... E04B 2/88
(Continued)

OTHER PUBLICATIONS

Chen et al., Eds., "Earthquake engineering for structural design," CRC Press, pp. 3.4.5.1. ISBN 0-8493-7234-8 (2006).
(Continued)

*Primary Examiner* — Paola Agudelo
(74) *Attorney, Agent, or Firm* — Jenkins, Taylor & Hunt, P.A.

(57) ABSTRACT

The present subject matter relates to systems and methods for providing resistance to soft story collapse in a multi-story structure. Such systems and methods includes providing a multi-story structure having a first floor and one or more upper floors, wherein a structural of the first floor is less than 70% of a structural stiffness of the one or more upper floors, and decreasing the structural stiffness of the one or more upper floors to be less than or substantially equal to the structural stiffness of the first floor.

6 Claims, 6 Drawing Sheets

(56) References Cited

U.S. PATENT DOCUMENTS

| | | | | |
|---|---|---|---|---|
| 10,961,704 | B2 * | 3/2021 | Daudet | E04B 2/789 |
| 11,078,682 | B1 * | 8/2021 | diGirolamo | E04B 1/2403 |
| 2002/0002801 | A1 * | 1/2002 | Fischer | E04C 3/46 52/653.1 |
| 2004/0083663 | A1 * | 5/2004 | Englekirk | E04H 9/02 52/167.1 |
| 2015/0176274 | A1 * | 6/2015 | James | E04C 2/384 52/696 |
| 2018/0044910 | A1 * | 2/2018 | Lastowski | E04B 1/388 |
| 2018/0334824 | A1 * | 11/2018 | Towfighi | E04B 1/18 |
| 2021/0095463 | A1 * | 4/2021 | Jiang | F16F 7/00 |

OTHER PUBLICATIONS

Trahern, "Common Seismic Damage to Wood Frame Structures," Cascade Crest Consulting Engineers, Northridge Earthquake 'Soft-Story' Example (Jan. 17, 1994), Archived from original on Apr. 23, 2009, retrieved online Mar. 28, 2022 (2 pages).

Perkins, "Earthquake Planner Warns of 'Soft-Story' Dangers," Realty Times (Nov. 6, 2003), Archived from original on Aug. 8, 2013, retrieved online Mar. 31, 2022 (4 pages).

Extreme Loading for Structures software, product webpage, Applied Science International, LLC, retrieved online Mar. 31, 2022 at https://www.extremeloading.com/ (15 pages).

* cited by examiner

SYSTEMS AND METHODS FOR RESISTING SOFT STORY COLLAPSE

PRIORITY CLAIM

The present application claims the benefit of U.S. Provisional Patent No. 62/987,701, filed Mar. 10, 2020, the disclosure of which is incorporated herein by reference in its entirety.

TECHNICAL FIELD

The subject matter disclosed herein relates generally to systems and methods for constructing multi-story buildings. More particularly, the subject matter disclosed herein relates to systems and methods for adapting a soft story structure to resist collapse under lateral loading conditions.

BACKGROUND

Buildings are classified as having a "soft story" if that level is less than 70% as stiff as the floor immediately above it, or less than 80% as stiff as the average stiffness of the three floors above it. [1] Soft story buildings are vulnerable to collapse in a moderate to severe earthquake in a phenomenon known as soft story collapse. [2] The inadequately-braced level is relatively less resistant than higher floors to lateral motion, so a significant amount of the building's overall side-to-side drift is focused on that floor. Subject to disproportionate lateral stress, and less able to withstand the stress, the floor becomes a weak point that may suffer structural damage or even failure, which in turn can result in the collapse of the entire building. [1]

Soft story failure was responsible for nearly half of all homes that became uninhabitable in California's Loma Prieta earthquake of 1989, and was projected to cause severe damage and possible destruction of 160,000 homes in the event of a more significant earthquake in the San Francisco Bay Area, California. [3]

It has been a common practice by structural engineers to design the structural skeleton of the buildings under both gravity and lateral loads. The behavior of the structural skeleton is usually well studied and the drift due to lateral loads is checked to ensure the serviceability requirements for non-structural elements. A typical sample of skeletal deformations under lateral loads is shown in FIGS. 1A and 1B, in which a bare structural skeleton, generally designated 10, is illustrated in both a neutral loading condition and a lateral loaded condition.

When a soft story building is subjected to lateral loads, the soft ground floor receives most of the energy and experience a larger drift due to the rigidity of the upper floors. This increased drift can cause plastic deformations at the ends of its columns which eventually lead to the collapse of the soft story. As illustrated in FIGS. 2A and 2B, for example, a soft story structural skeleton, generally designated 20 and including a soft story 21 on the ground floor and one or more rigid story 30 above, is illustrated in both a neutral loading condition and a lateral loaded condition. The common practice to avoid soft story buildings is to increase the soft story rigidity either by increasing the size of the structural members in this floor to create a reinforced soft story 22 as illustrated in FIGS. 3A and 3B or by adding braces in the soft story to create a braced soft story 23 as shown in FIGS. 4A and 4B. These solutions, however, may limit the architectural function of the open floor.

As a result, it would be desirable to develop systems and methods to design, adapt, or otherwise configure a multi-story structure exhibiting a soft story construction to resist collapse under lateral loading.

SUMMARY

In accordance with this disclosure, systems and methods for providing resistance to soft story collapse in a multi-story structure are provided. In one aspect, such a method includes providing a multi-story structure having a first floor and one or more upper floors, wherein a structural stiffness of the first floor is less than 70% of a structural stiffness of the one or more upper floors, and decreasing the structural stiffness of the one or more upper floors to be less than or substantially equal to the structural stiffness of the first floor.

In another aspect, a multi-story structure includes a first floor and one or more upper floors. The one or more upper floors comprise a structural frame and one or more infill walls, and the structural frame is substantially decoupled from the one or more infill walls such that in-plane interaction is reduced during seismic action. A connector assembly is connected between the structural frame and the one or more infill walls, wherein the connector assembly comprises slots that allow relative horizontal movement in an in-plane direction between the structural frame and the one or more infill walls and/or allow both relative horizontal and vertical movements in in-plane directions between the structural frame and the one or more infill walls. In this way, a structural stiffness of the one or more upper floors is less than or substantially equivalent to a structural stiffness of the first floor.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides systems and methods for adapting a soft story structure to resist collapse under lateral loading conditions, such as during extreme loading scenarios such as an earthquake. In one aspect, rather than increasing the stiffness of the ground floor, the present subject matter provides systems and methods for decreasing the stiffness of the upper floors while maintaining structural stability, in some configurations reaching the original stiffness of the bare frame and hence eliminating the possibility of any soft story and keep the architectural functions of all floors unchanged.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

Figures 1A, 1B:
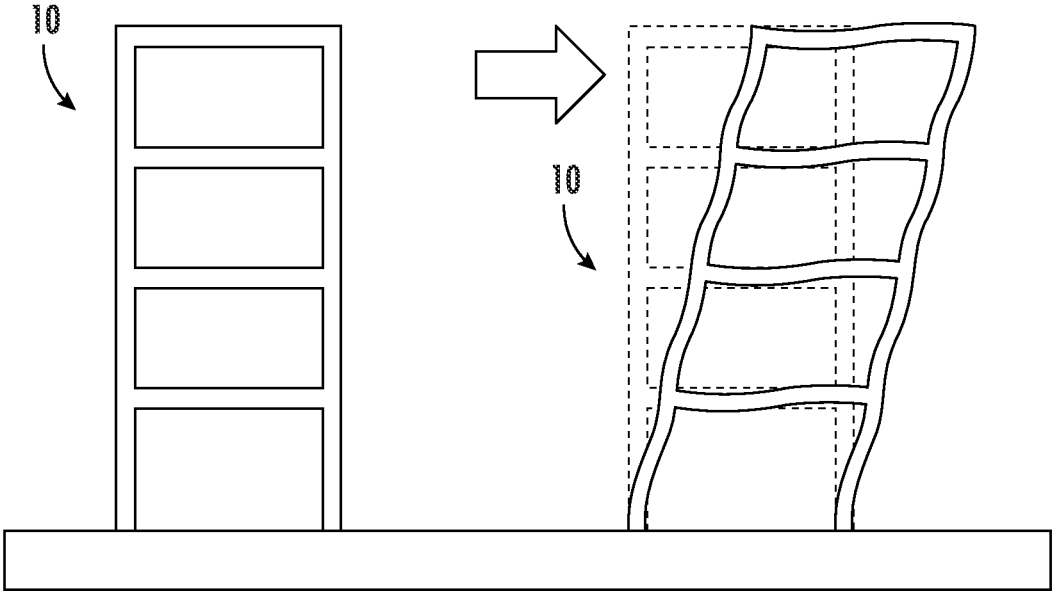
FIGS. 1A and 1B are side views of a bare structural skeleton under neutral loading conditions and lateral loading conditions.
Figures 2A, 2B:
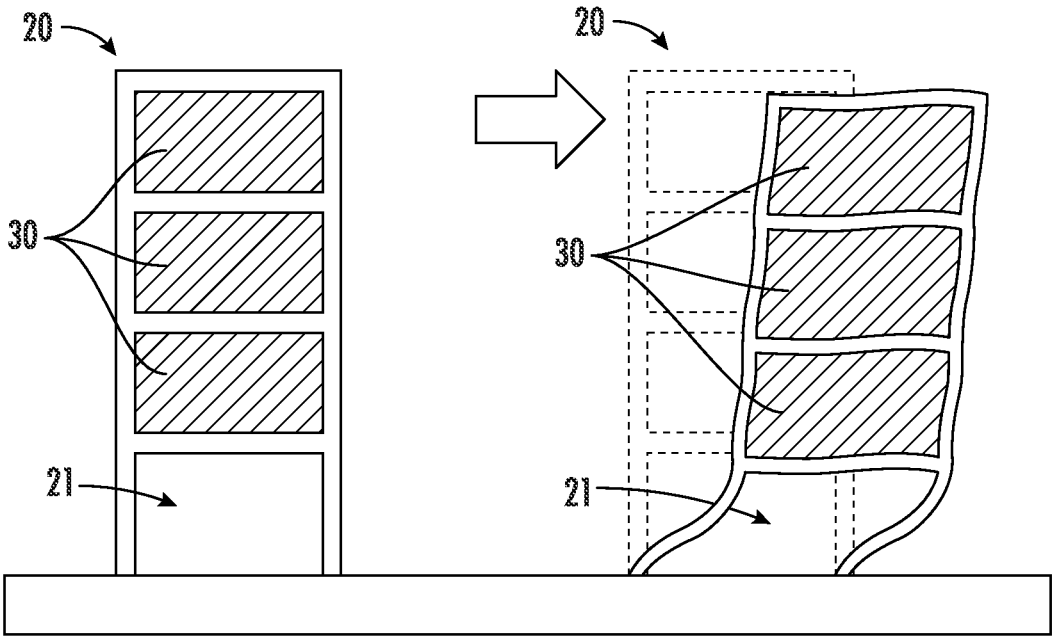
FIGS. 2A and 2B are side views of a structural skeleton having a soft story on the ground floor under neutral loading conditions and lateral loading conditions under a conventional configuration.
Figures 3A, 3B:
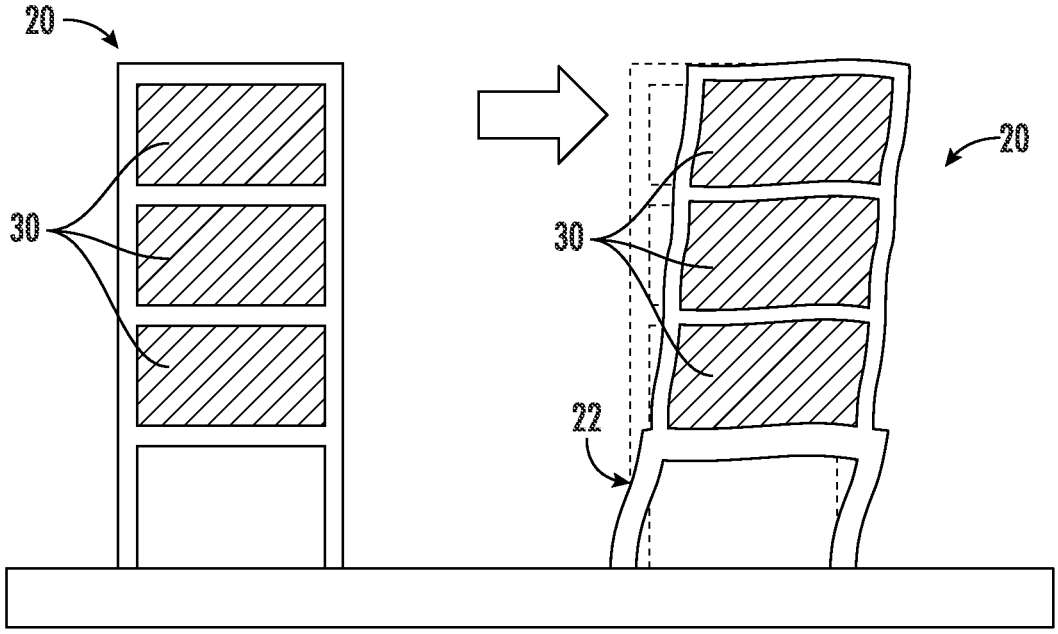
FIGS. 3A and 3B are side views of a structural skeleton having a reinforced soft story on the ground floor under neutral loading conditions and lateral loading conditions under a conventional configuration.
Figures 4A, 4B:
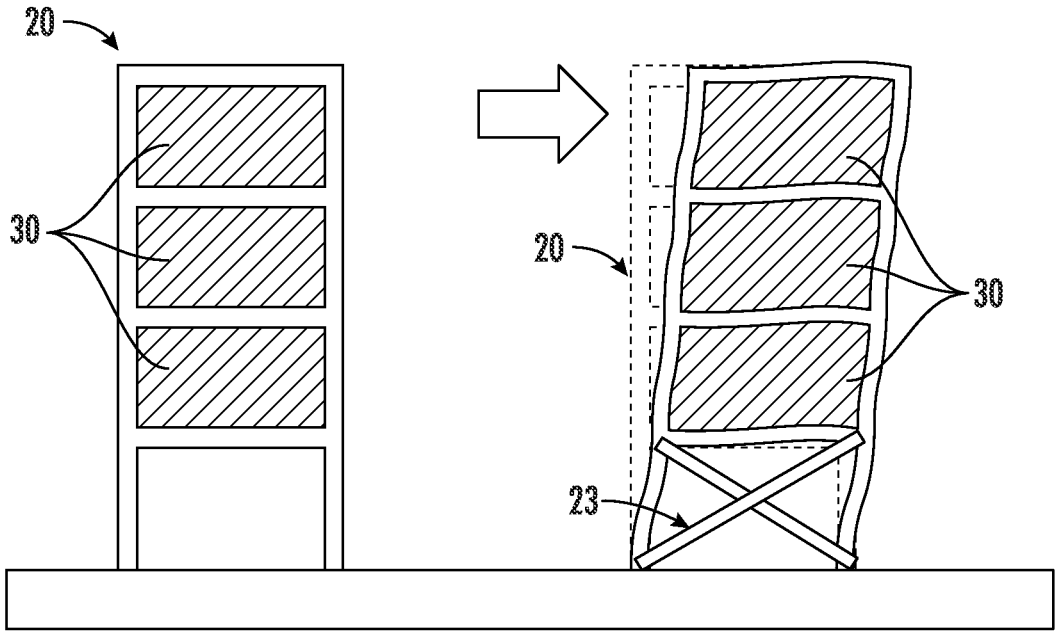
FIGS. 4A and 4B are side views of a structural skeleton having a braced soft story on the ground floor under neutral loading conditions and lateral loading conditions under a conventional configuration.
Figures 5A, 5B:
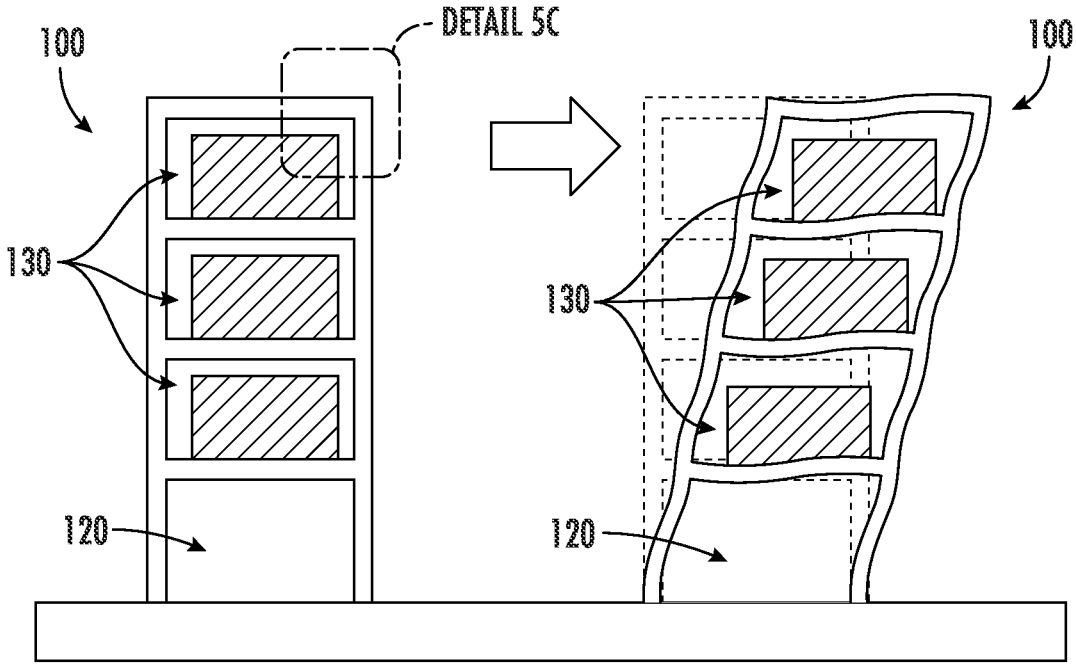
FIGS. 5A and 5B are side views of a structural skeleton having a soft story on the ground floor but decoupled infill structures on upper floors according to an embodiment of the presently disclosed subject matter.

As shown in FIGS. 5A and 5B, the presently disclosed subject matter provides a building having a modified structural skeleton, generally designated 100, which includes one or more soft story 120 on a lower floor beneath one or more upper floor 130, the one or more upper floor 130 each comprising a structural frame 131 and one or more infill wall 132. As discussed above, the one or more soft story 120 can be characterized as such in configurations in which the one or more soft story 120 is less than 70% of a structural stiffness of the one or more upper floor 130 or less than 80% as stiff as the average stiffness of the three floors above it. To address this problem with differential structural stiffness in the floors of conventional configurations, the structural stiffness of the one or more upper floor 130 can be decreased to be less than or substantially equal to the structural stiffness of the one or more soft story 120. In some embodiments, the structural stiffness of the one or more upper floor 130 is adjusted to be less than or substantially equal to a structural stiffness of a floor having only a bare structural frame.

Figure 5C:
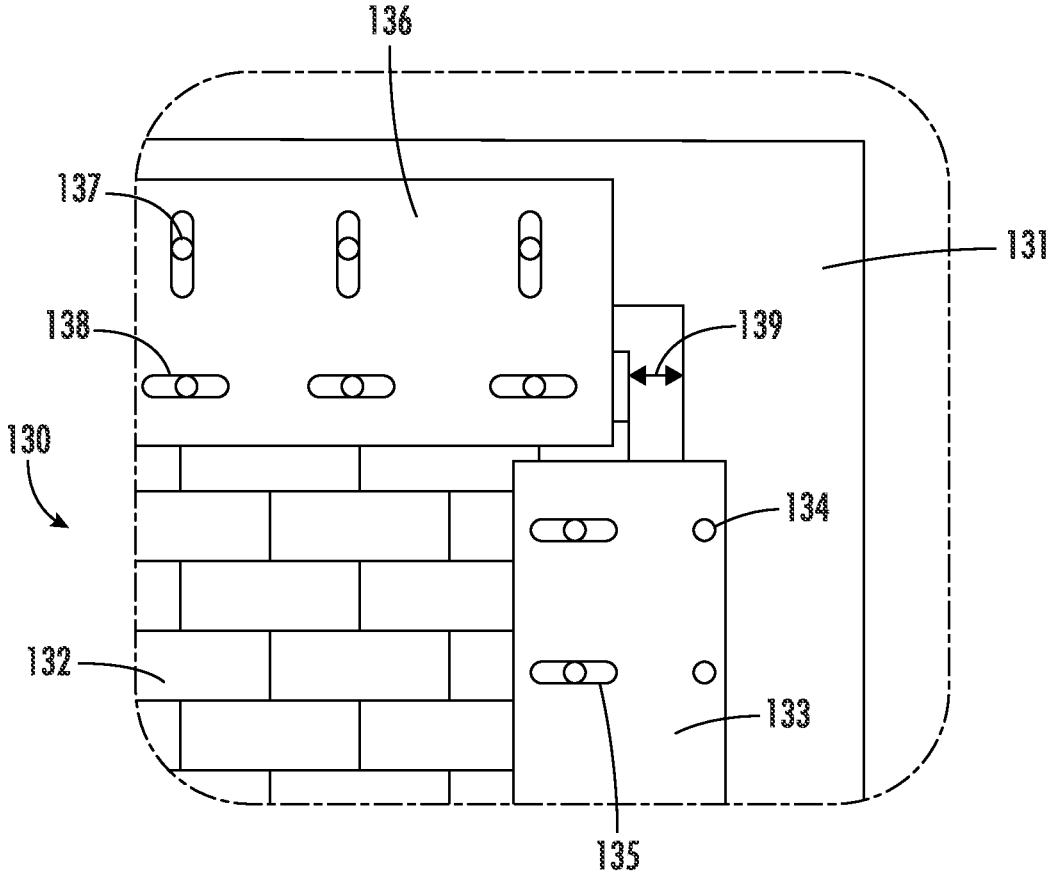
FIG. 5C is a detail side view of a decoupled infill structure on an upper floor according to an embodiment of the presently disclosed subject matter.

In some embodiments, this decrease of the structural stiffness can be achieved by limiting or substantially eliminating the in-plane interaction of the infill wall 132 with the structural frame 131. To achieve this reduction in the in-plane interaction, in some embodiments, each infill wall 132 is decoupled from the structural frame 131 in a way that substantially no interaction (e.g., minimum 50% reduction up to full isolation) is possible during seismic action, at least up to a predetermined threshold of lateral displacement. Referring to one exemplary configuration shown in FIG. 5C, in some embodiments, this decoupling is provided by a gap 139 that is intentionally left between the infill wall 132 and the structural frame 131 so that the overall system does not work as in-filled frames. Although the gap 139 is shown in FIG. 5C between a lateral edge of the infill wall 132 and the structural frame 131, a further gap can likewise be provided between an upper edge of the infill wall 132 and the structural frame 131. The size of each gap 139 can be designed based on a selected maximum displacement expected to be encountered for a given application. The specific size of the gap 139 can be selected based on the location of the building relative to known earthquake zones and/or fault lines. In some embodiments, the gap 139 can have a dimension between about ¾" and 2" (including 1" and 1½"), although larger dimensions of 4" or greater could be used depending on the design considerations for a given construction.

Further, in some embodiments, an arrangement of connectors can be used as shown in FIG. 5C to provide a limited connection across this gap 139 and to ensure the out-of-plane stability of the infill. In some embodiments, one or more first connector 133 is connected at a first end to one of the one or more infill wall 132 and at a second end to the structural frame 131, such as at a vertical support column of the structural frame 131 that is positioned to either side of the infill wall 132. In some particular embodiments, the first end of the one or more first connector 133 is provided with one or more first horizontal slot 135 within which a fastener can be received for attaching the one or more first connector 133 to the infill wall 132, while the second end is configured to be fixedly connected to the structural frame 131 at an attachment point 134. In this way, the slotted connection of the one or more first connector 133 to the infill wall 132 allows for some degree of relative horizontal movement between the infill wall 132 and the structural frame 131, but vertical movement and out-of-plane movement is restricted. The design of the one or more first horizontal slot 135 can be configured to have a length that corresponds to the selected maximum displacement expected to be encountered for a given application. In some embodiments, the length of the one or more first horizontal slot 135 can be double the dimension of the gap 139 to account for lateral movement in either direction.

Similarly, in some embodiments, one or more second connector 136 is connected at a first end to one of the infill wall 132 and at a second end to the structural frame 131, such as at an upper beam of the structural frame 131 for a given one of the one or more upper floor 130. In some particular embodiments, the first end of the one or more second connector 136 is provided with one or more second horizontal slot 138 within which a fastener can be received for attaching the one or more second connector 133 to the infill wall 132, while the second end is provided with one or more vertical slot 137 within which a fastener can be received for attaching the one or more second connector 136 to the structural frame 131. In this way, the slotted connections of the one or more second connector 136 to the infill wall 132 and to the structural frame 131 can be oriented to allow for some degree of both relative horizontal movement and relative vertical movement between the infill wall 132 and the structural frame 131, but out-of-plane movement is restricted. The design of the one or more second horizontal slot 138 and the one or more vertical slot 137 can be configured to have respective lengths that correspond to the selected maximum displacement expected to be encountered for a given application. In some embodiments, the length of the one or more second horizontal slot 138 can be double the dimension of the gap 139. In some embodiments, the length of the one or more vertical slot 137 can be sized for an expected vertical displacement that corresponds to a given lateral drift for which the gap 139 is sized.

With this combination of connectors, the one or more infill wall 132 can be structurally supported by the structural frame 131 while reducing or eliminating the in-plane reaction between the structures. In this way, the one or more infill wall 132 is substantially decoupled from the structural frame 131 in selected degrees of freedom to reduce the overall structural stiffness of the one or more upper floor 130. Those having ordinary skill in the art will recognize that, for the particular connector assembly discussed above, this decoupling can be limited by the relative sizes of the gap 139, the one or more first horizontal slot 135, the one or more second horizontal slot 138, and/or the one or more vertical slot 137.

Figure 6:
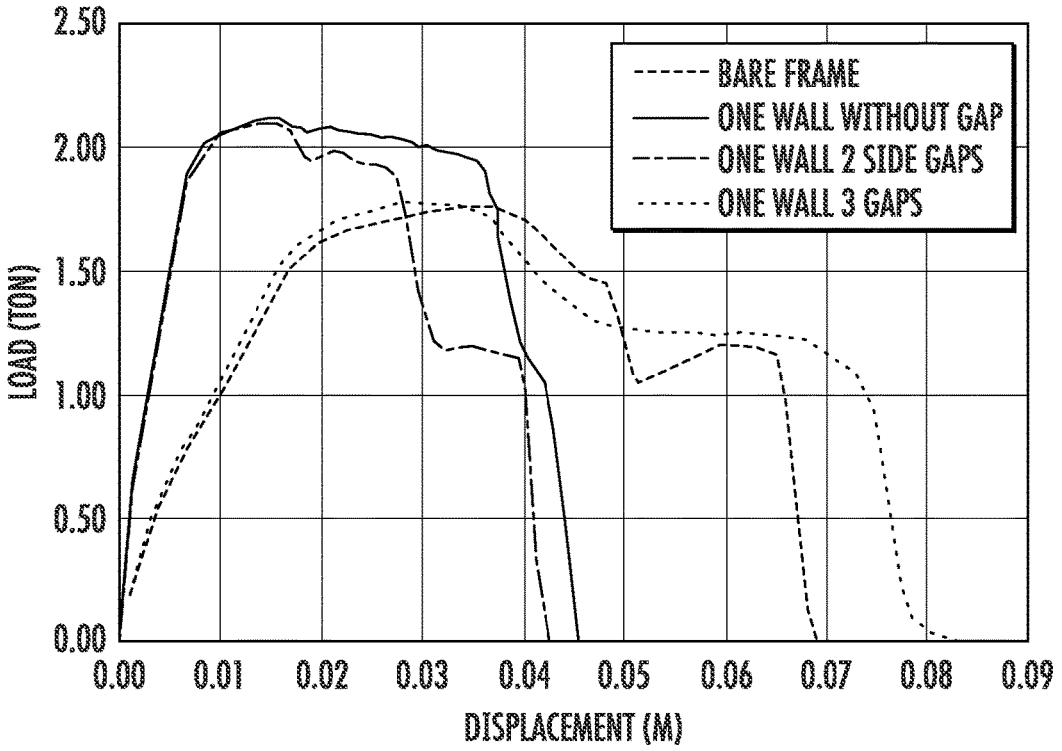
FIG. 6 is a graph illustrating results of a static analysis comparing different structure configurations.

A numerical analysis was carried out for the proof of the concept. The software used was the Extreme Loading for Structures (ELS) [4], which is based on the Applied Element Method (AEM) due to its ability to follow the structural collapse, partial or total, of the structure. First, the ELS was used to study a two story frame with the ground floor open without any infill while the first floor has four cases: 1) Open without any infill; 2) Infilled with brick wall; 3) Infilled with brick wall that is separated from the columns; and 4) Infilled with brick wall that is separated from the columns and the top beam. Within each model, the frame is subjected to static lateral displacement at its top floor. The results of the numerical analysis are shown in FIG. 6. The analysis showed that an infilled brick wall (case 2) exhibits stiffer behavior than a bare frame (case 1), but failure happens earlier at a lateral displacement of half that of the bare frame failure displacement. The infilled brick wall case showed a soft story collapse, with the strain localized at the ground open floor.

By applying gaps with columns (case 3), the behavior changed slightly, but soft story collapse also was observed. Despite the decoupling of the ends of the infilled wall, it is evident that the unaltered interaction of the wall and the upper beam still resulted in an infill interaction with the structural frame. When gaps are applied with both the columns and the upper beam (case 4), however, there was no infill interaction and the behavior was similar to the bare frame behavior with no soft story collapse as shown in FIG. 6. This is evidence of the efficiency of the presently disclosed subject matter.

Figure 7A:
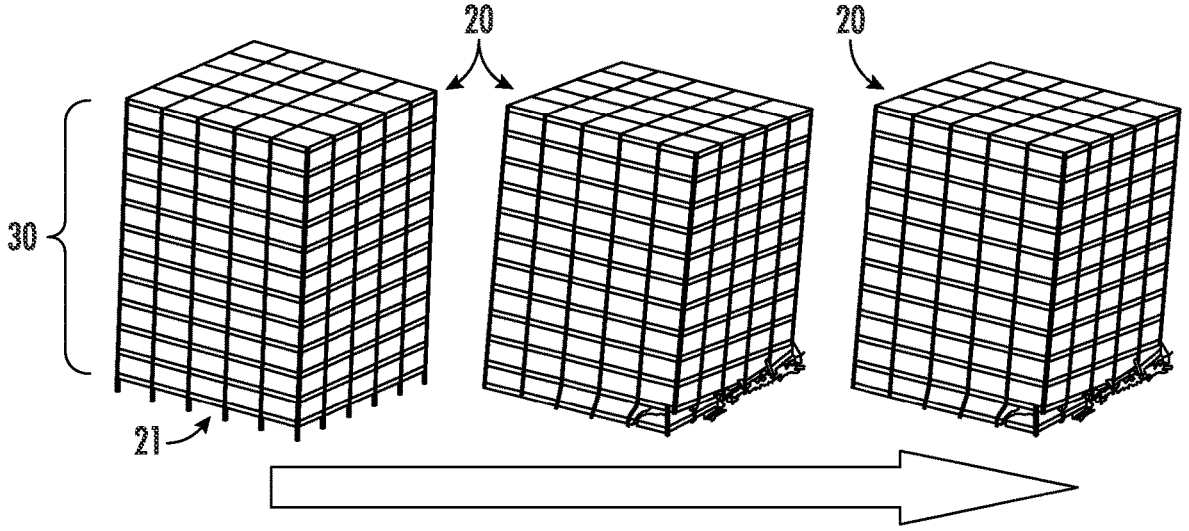
FIG. 7A is a sequence of side perspective views of a soft story collapse of a multi-story building modeled using a conventional configuration.
Figure 7B:
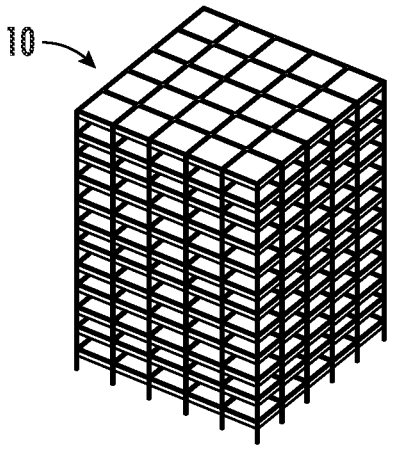
FIG. 7B is a side perspective view of a multi-story building having a bare frame configuration.
Figure 7C:
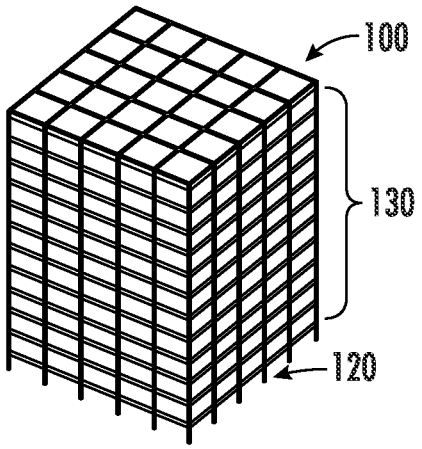
FIG. 7C is a side perspective view of a multi-story building having a soft story on the ground floor but decoupled infill structures on upper floors according to an embodiment of the presently disclosed subject matter.

To further comprehensively investigate the principles discussed above, 3D nonlinear dynamic analysis was carried out for a conventional configuration of a multi-story, reinforced concrete building 10 that has a soft story 21 below a plurality of rigid stories 30 as shown in FIG. 7A. The building is subjected to a scaled-down Elcentro earthquake. The ELS results showed the soft story collapse. For comparison, a similar analysis was performed for similarly-sized multi-store building 10 having only a bare frame (i.e., only reinforced concrete skeleton without masonry infill). This analysis showed a good performance under the same earthquake loading as shown in FIG. 7B. A similar multi-story building 100 constructed using the presently disclosed systems and methods was also analyzed using the same parameters. As shown in FIG. 7C, the performance of the building 100 with the proposed technique exhibits almost the same behavior that was numerically observed for the bare frame behavior.

Figure 8:
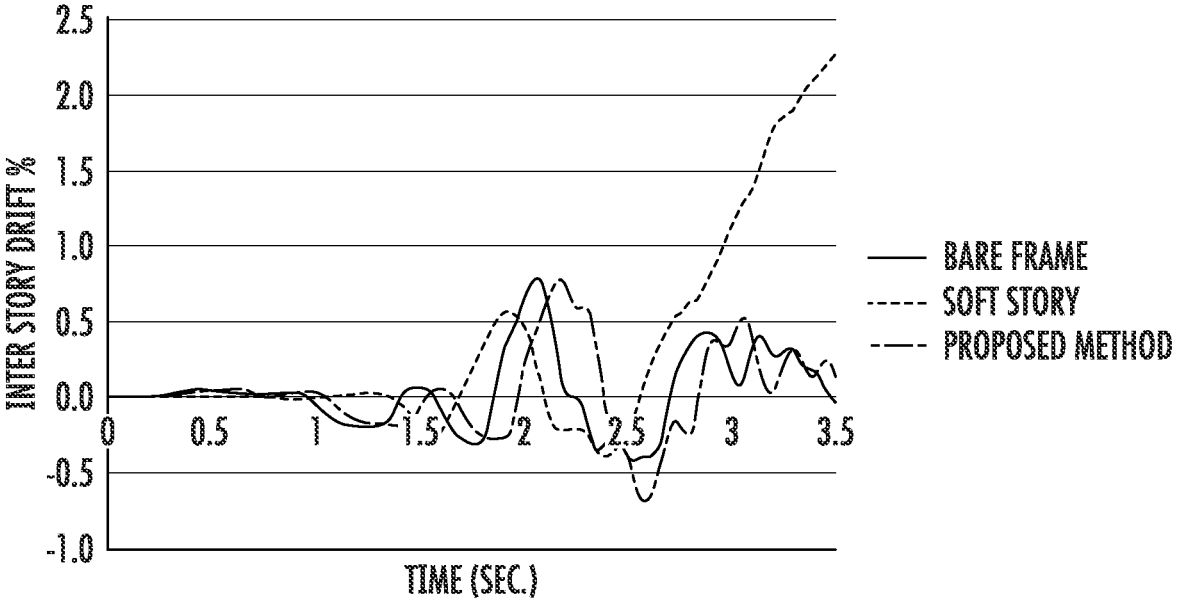
FIG. 8 is a graph illustrating a comparison of maximum inter-story drive for a bare frame structure, a multi-story building having a soft story on the ground floor according to a conventional configuration, and a multi-story building having a soft story on the ground floor but decoupled infill structures on upper floors according to an embodiment of the presently disclosed subject matter.

FIG. 8 illustrates a representative, non-limiting comparison of the maximum inter-story drift for the bare frame, the soft story building, and the building configured according to the presently disclosed subject matter. The maximum inter-story drift for the skeleton RC building is 0.77%, whereas for the soft story building it exceeded 2.25%, beyond which the building collapses. When the proposed technique is introduced, the maximum inter-story drift stepped down to 0.77% again verifying the proposed concept of eliminating the walls' contribution in deformation under earthquake loading and hence eliminating the soft story mechanism.

The soft story issue was numerically proved to be avoided by the presently disclosed subject matter, which is different from currently worldwide used methods for designing and/or retrofitting multistory building with a potential soft story collapse. Steel connections are employed to connect the infill walls with the reinforced concrete skeleton in order to assure no interaction between infill walls and skeleton structure during seismic action. The connections should allow a relative displacement higher than the design inter-story drift.

The following U.S. patent documents are incorporated herein by reference in their entireties: U.S. Pat. No. 5,906,080 to di Girolamo et al., U.S. Pat. No. 6,612,087 to di Girolamo et al., U.S. Pat. No. 7,503,150 to di Girolamo et al., U.S. Pat. No. 8,387,321 to di Girolamo et al., and U.S. Pat. No. 8,683,770 to di Girolamo et al.

REFERENCES

1) Wai-Fah Chen, E. M. Lui (2005). Earthquake engineering for structural design. CRC Press. p. 3.4.5.1. ISBN 0-8493-7234-8.
2) Eugene Trahern (1994 Jan. 17). "Northridge Earthquake "Soft-Story" Example". Archived from the original on Apr. 23, 2009.
3) Broderick Perkins (2003 Nov. 6). "Earthquake Planner Warns Of "Soft-Story" Dangers". Realty Times. Archived from the original on Aug. 8, 2013.
4) Extreme Loading for Structures software, www.applied-scienceint.com The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A method for providing resistance to soft story collapse in a multi-story structure, the method comprising:

providing a multi-story structure having a first floor and one or more upper floors, wherein a structural stiffness of the first floor is less than 70% of a structural stiffness of the one or more upper floors; and decreasing the structural stiffness of the one or more upper floors to be less than or substantially equal to the structural stiffness of the first floor, wherein the one or more upper floors comprise a structural frame and one or more infill walls, and wherein decreasing the structural stiffness of the one or more upper floors comprises modifying the structural frame and the one or more infill wall of the one or more upper floors to have no in-plane interaction.

2. A method for providing resistance to soft story collapse in a multi-story structure, the method comprising:

providing a multi-story structure having a first floor and one or more upper floors, wherein a structural stiffness of the first floor is less than 70% of a structural stiffness of the one or more upper floors; and decreasing the structural stiffness of the one or more upper floors to be less than or substantially equal to the structural stiffness of the first floor, wherein the one or more upper floors comprise a structural frame and one or more infill walls, and wherein the structural frame is substantially decoupled from the one or more infill wall of the one or more upper floors such that in-plane interaction is reduced.

3. The method of claim 2, comprising providing a gap between the structural frame and the one or more infill wall of the one or more upper floors.

4. The method of claim 3, comprising connecting a connector assembly to the one or more infill wall and to the structural frame across the gap.

5. The method of claim 4, wherein one or more components of the connector assembly is made of steel.

6. The method of claim 4, wherein the connector assembly comprises slots that allow relative horizontal movement between the structural frame and the one or more infill walls or allow both relative horizontal and vertical movements between the structural frame and the one or more infill walls.

* * * * *